US009220306B2

(12) United States Patent
Majoros

(10) Patent No.: US 9,220,306 B2
(45) Date of Patent: Dec. 29, 2015

(54) APPAREL LINER

(76) Inventor: Anthony E. Majoros, Cypress, CA (US)

( * ) Notice: Subject to any disclaimer, the term of this patent is extended or adjusted under 35 U.S.C. 154(b) by 87 days.

(21) Appl. No.: 12/962,521

(22) Filed: Dec. 7, 2010

(65) Prior Publication Data

US 2012/0137411 A1 Jun. 7, 2012

(51) Int. Cl.

*A41D 13/005* (2006.01)
*A41D 27/02* (2006.01)
*A41D 13/00* (2006.01)

(52) U.S. Cl.

CPC ..... *A41D 13/0053* (2013.01); *A41D 27/02* (2013.01)

(58) Field of Classification Search

CPC ..... A62B 18/006; A62B 18/10; A62B 7/12; A62B 17/00; A62B 17/005; A62B 18/00; A62B 9/02; A41D 13/0053; A41D 13/005
USPC ..... 2/458, 2.11–2.17, 69, 81, 97, 272, 2/DIG. 1

See application file for complete search history.

(56) References Cited

U.S. PATENT DOCUMENTS 6,293,121 B1 * 9/2001 Labrador ..... 62/304
7,015,692 B2 * 3/2006 Clarke et al. ..... 324/300
2002/0073994 A1 * 6/2002 Patel ..... 128/201.17
2003/0028948 A1 * 2/2003 Chambers ..... 2/69
2003/0106551 A1 * 6/2003 Sprinkel et al. ..... 128/203.16
2003/0121908 A1 * 7/2003 Pilavdzic et al. ..... 219/630
2004/0065658 A1 * 4/2004 Damiano et al. ..... 219/524
2004/0074250 A1 * 4/2004 Junkins ..... 62/259.3
2004/0089650 A1 * 5/2004 Diepholz et al. ..... 219/488
2004/0091252 A1 * 5/2004 Diepholz ..... 392/488
2004/0149733 A1 * 8/2004 Abbott et al. ..... 219/535
2004/0237178 A1 * 12/2004 Landeros ..... 2/457
2005/0115567 A1 * 6/2005 Bridges et al. ..... 128/206.21
2005/0187527 A1 * 8/2005 Rix ..... 604/289
2005/0268907 A1 * 12/2005 McFarlane ..... 128/201.22
2006/0175337 A1 * 8/2006 Defosset ..... 220/581
2006/0191277 A1 * 8/2006 Defosset ..... 62/259.3
2007/0221692 A1 * 9/2007 Witten ..... 224/148.2
2010/0037891 A1 * 2/2010 Walker et al. ..... 128/201.23
2010/0108067 A1 * 5/2010 Walker et al. ..... 128/205.24

* cited by examiner

*Primary Examiner* — Bobby Muromoto, Jr.
(74) *Attorney, Agent, or Firm* — Jeffer Mangels Butler & Mitchell LLP; Brennan C. Swain, Esq.

(57) ABSTRACT

An apparel liner for cooling is provided. The apparel liner includes a liner for a user's outer garment, formed from three layers. The first panel is in contact with the wearer's outer clothing, the second panel is spacer fabric having thickness and cellular structure. The second spacer panel is disposed over the first panel. The third panel faces the wearer's clothing (e.g. a shirt) under the outer garment. Holes are distributed over the surface of the third panel. All three layers may be sewn or fixed into a single fabric. An air inlet fitting is provided near the waistband for attachment of an air distribution hose. This air distribution hose is then connected to an air movement device.

18 Claims, 9 Drawing Sheets

APPAREL LINER

BACKGROUND

1. Field

The present disclosure relates generally to an apparel liner, and, in particular, to an apparatus for distributing high volume, low pressure air through apparel such as jackets and vests.

2. Background

Motorcycles serve as both daily transportation and recreational vehicles for many individuals who are drawn to unique open-air riding. Over the years, motorcycles have evolved into a wide variety of models that are designed for particular types of riding such as off-road hill climbing challenges and classic street bikes. Each of these different types of motorcycles require riders to wear protective gear while riding to, inter alia, guard against head and body injuries.

Protective gear usually consists of a helmet and often, a leather jacket. Some riders may also add leather chaps. These jackets, vests, and chaps or pants may be made of leather or synthetic materials that are durable and provide protection against abrasion in the event of a fall. In some cases, abrasion-resistant padding may be used for extra protection.

State law may often require protective gear, such as helmets. Many riders choose to wear additional protective gear along with their helmets. The prudent desire for safety can come with a drawback. Because many motorcycle riders prefer to ride during warm weather, they may find their protective gear too hot, especially at low speeds or when stopped. Depending on the temperature, this may lead to riders experiencing heat stress. In hot weather, about 90 to 95 degrees Fahrenheit, temperatures inside a typical jacket may reach 120 degrees (° F.). Temperatures inside a helmet may reach 125 degrees (° F.).

Previous solutions to the problems of overheating and/or heat stress in motorcycle riders have focused on providing specialized cooling vests that are worn in addition to a jacket. Some methods have relied on the addition of gel cooling packs or phase change compounds to vests or have relied on evaporative wraps worn against or very close to the skin to cool the wearer. In some cases, air is pre-chilled and fans or blowers are used to supply the cool air to the rider's vest; chilled water pumped through tubing incorporated into vests has also been used for a cooling effect. When air is used as the cooling medium in these cases, the ambient air must be moved relatively slowly over the chilling mechanism in order to extract heat from the air; in turn, this slow movement of air requires a tight-fitting vest for distribution as directly as possible over the rider's skin. Thus, while chilled air provides a cooling effect, the approach requires a specialized vest and, by moving only small volumes of air at low rates (approximately 10 to 20 cubic feet per minute), this type of cooling does not effectively promote evaporation of perspiration, which is the body's natural cooling mechanism. Because these methods require the rider to wear a specialized vest (e.g., a close fitting garment with straps, air channels, ducts, tubing, or pockets with cooling gels), many riders object to such cooling methods because the appearance detracts from their comfort and/or the "look" they would like to project while riding their motorcycle.

Further prior solutions have included specialized fabrics that rely on mesh or ventilation to provide cooling. These solutions suffer from the drawback that the motorcycle must be moving in order for air to flow through or over the specialized fabric to cool the rider. These solutions are ineffective at slow speed or when stopped.

There is a need in the art for apparel that promotes natural cooling through high volume air distribution (approximately 100 cubic feet per minute) and allows for incorporation into standard riding apparel.

SUMMARY OF THE INVENTION

An apparel liner for cooling is provided. The apparel liner consists of a liner for a user's outer garment, formed from three layers. The first panel is in contact with the wearer's outer clothing, the second panel is spacer fabric having thickness and cellular structure. The second spacer panel is disposed over the first panel. The third panel faces the wearer's clothing (e.g. a shirt) under the outer garment. Holes are distributed over the surface of the third panel. All three layers may be sewn or fixed into a single fabric. An air inlet fitting is provided near the waistband for attachment of an air distribution hose. This air distribution hose is then connected to an air movement device.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF PREFERRED EMBODIMENTS

Figure 1:
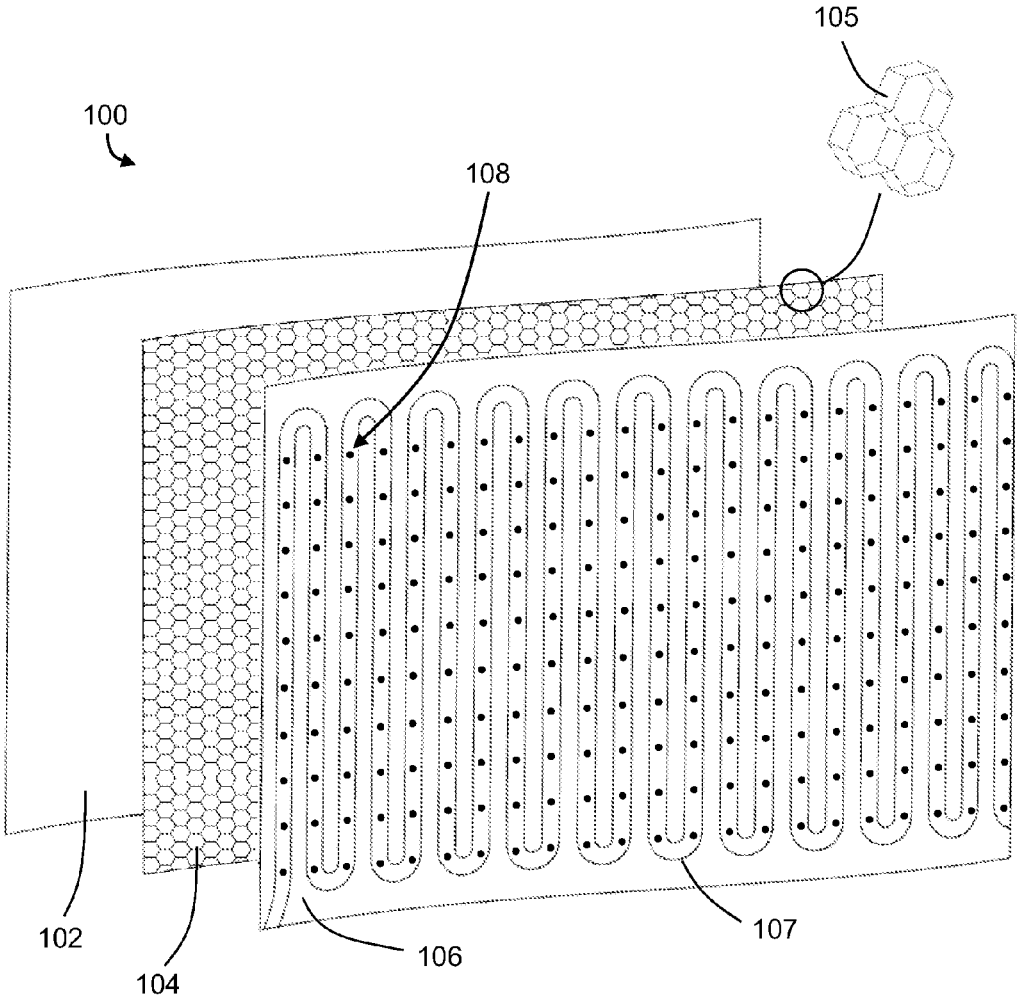
FIG. 1 is perspective exploded view of a preferred embodiment of a rectangular section of apparel liner.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

An apparel liner, such as a liner for a jacket or other motorsports apparel, is provided below. The liner may be attached to an existing piece of apparel using a zipper or other attachment means, and preferably has air distribution holes and at least one fitting, typically at the waistband. The fitting is an attachment point for an air supply hose. Air is pumped into the liner through the fitting and is distributed through the space within the liner over the wearer's shirt or other clothing. Air flows over the wearer through the holes in the innermost layer of the apparel liner, providing air movement.

Referring now to FIG. 1, a preferred embodiment of a piece of apparel liner 100 is shown. The liner 100 is preferably composed of an outer panel 102 for contact with a wearer's outer apparel such as a jacket. This outer panel 102 is preferably made from lightweight rip stop nylon or any other suitable material with low air permeability. Middle panel 104 is preferably a polyester spacer fabric that separates the inner and outer panels 102 and 106 of the apparel liner 100. Middle panel 104 preferably has a honeycomb style or cellular construction. However, any spacer fabric that separates the inner and outer panels 102 and 106 and allows airflow through the middle panel between the panels 102, 106 of the apparel liner 100 can be used in its stead. Individual honeycomb or hexagonal cells 105 are shown in the close up view of FIG. 1. The middle fabric panel 104 is used to maintain space between faces of the honeycombs or other structures 105 and to allow lateral movement of air between the faces. Inner panel 106 is for contact with the wearer's shirt or other clothing or body. Inner panel 106 is preferably made from urethane coated rip stop nylon and has holes 108 punched through the panel and distributed over the surface of panel 106. The urethane coating reduces migration of evaporated perspiration back into the liner 100 and also facilitates punching clean holes in the nylon fabric during manufacture. Holes 108 are preferably 1/16" in diameter and located on 1½" centers throughout the entire surface of inner panel 106. However, both the size and spacing of holes 108 may be varied over the surface of layer 106. For example, the density of holes 108 may be varied to provide pressure sinks and to increase flow to specific areas on the wearer. Also, resistive heating fabric or wires 107 are shown bonded to inner panel 106, e.g. to provide heating in colder weather. The air that flows through holes 108 in inner panel 106 can aid in the natural cooling of the wearer via evaporation of the wearer's perspiration. When the liner 100 shown in FIG. 1 is used in a garment, the air exits at the waistband, collar, and sleeve openings of the wearer's jacket.

Figure 2:
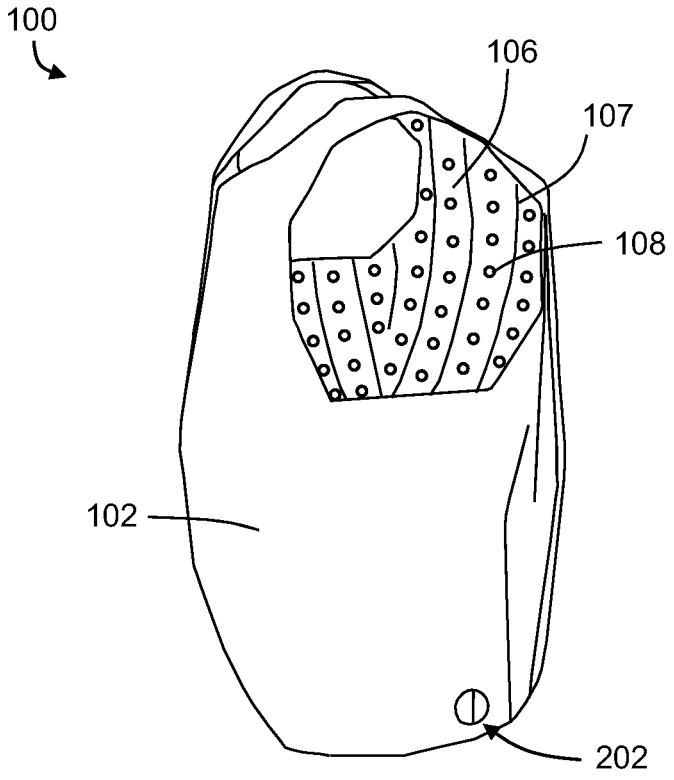
FIG. 2 is perspective side view of a preferred embodiment of an apparel liner in a sleeveless vest configuration.

Referring now to FIG. 2, the liner 100 is shown in a vest configuration. The outer panel 102 is now the exterior of the vest 100. The inner panel 106 is now the interior of the vest 100. The middle fabric panel 104, though not shown in FIG. 2, separates the two layers 102 and 106. The panels 102, 104 and 106 are held together by numerous individual loop stitches. The individual loop stitches are positioned over the walls of the cells 105 found in middle layer 104. Accordingly, this vest 100 functions as a pressure vessel. When air is pumped into an air inlet 202 on outer panel 102, the air flows between inner panel 106 and outer panel 102, as held apart by middle cellular panel 104. The air can then escape through holes 108 in the inner panel 106 onto the wearer for cooling (or heating) purposes. An upper outlet fitting 302 may also be provided on vest 100. If the upper outlet fitting 302 is closed or blocked, more air remains in the vest 100 to flow between panels 102 and 106 and to discharge through holes 108 onto the wearer.

Air inlet fitting 202 preferably is placed in the lower left aspect of the vest 100, situated so as to be beneath outer apparel or a jacket, so that the fitting 202 is not visible beneath the apparel. When not in use, the air inlet fitting 202 may be positioned against the jacket or apparel waistband.

Figure 3:
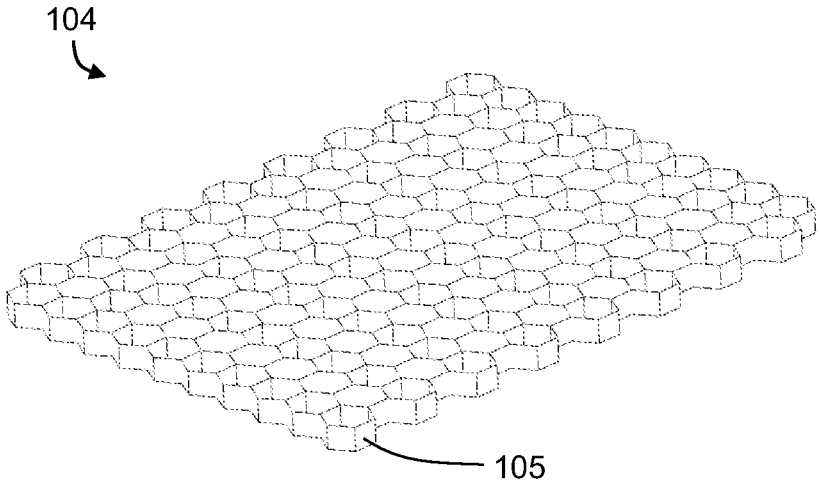
FIG. 3 is a perspective view of a preferred embodiment of a middle fabric panel.

Referring now to FIG. 3, a close-up view of a preferred embodiment of middle fabric panel 104 is shown. As discussed, the fabric serves as a spacer for liner 100. The fabric depicted preferably has cells 105 approximately 3/16" wide and approximately 3/16" thick and is preferably made from polyester. However, any suitable spacing material with open cells may be used without departing from the spirit of the invention shown. Selection of spacer fabric thickness and cell size for middle panel 104 may vary depending on airflow considerations.

Returning now to FIG. 2, while the liner 100 is shown as a sleeveless vest, sleeves may easily be incorporated into the liner 100 for cooling a wearer's arms by stitching, bonding, or other means. Also shown in FIG. 2 is the general position of the lower inlet air fitting 202. The orientation of air inlet fitting 202 is intended to be downward facing. This orientation is achieved by sewing or attaching a fabric tab to hold air inlet fitting 202, into the lower edge of liner 100.

The apparel liner 100 can incorporate various pneumatic fittings. As noted above, a lower air inlet fitting 202 is preferably located at the waistband of the apparel liner 100. The lower air inlet fitting 202 is a female fitting that connects an air supply hose 200 (having a male end) to apparel liner 100. The lower fitting 202 is preferably a break-away fitting designed to release the air supply hose 200 in the event the wearer dismounts a motorcycle without disengaging the air supply hose 200, or is thrown from the motorcycle in an accident. FIGS. 8*a*-8*d* inclusive depict a preferred embodiment of the connection of the air supply hose 200 with an air inlet fitting 202. A similarly comprised upper air outlet fitting 302 may also be included in apparel liner 100. This upper air outlet fitting 302 is preferably located in the collar area of apparel liner 100 and may be used for drawing off a portion of the air from the liner, e.g. for routing to a motorcycle helmet 400 via an outlet supply hose 300. Such a configuration is shown in FIGS. 4 and 5.

Figure 4:
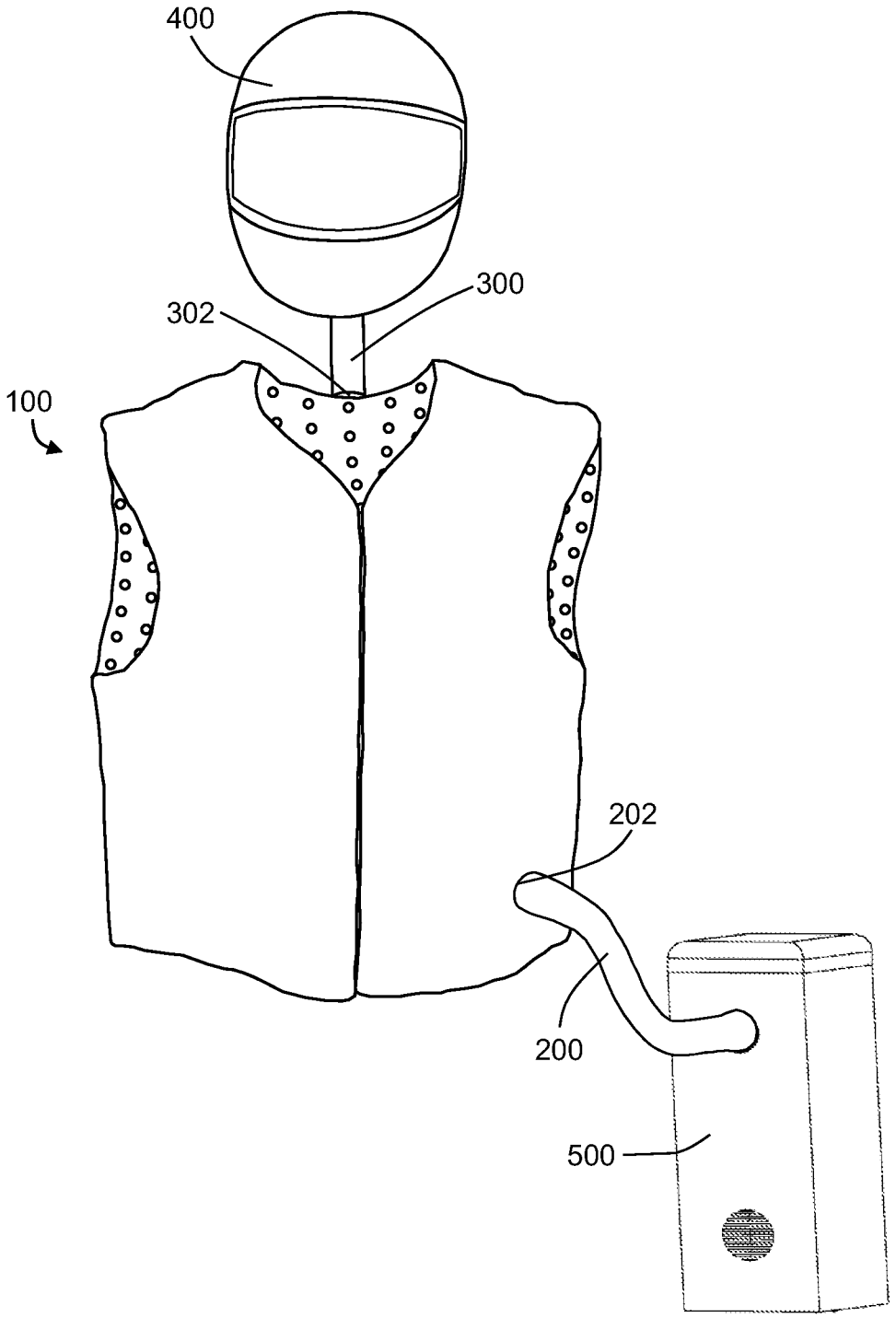
FIG. 4 is a front perspective view of a preferred embodiment of the apparel liner connected to an air supply and a helmet.
Figure 5:
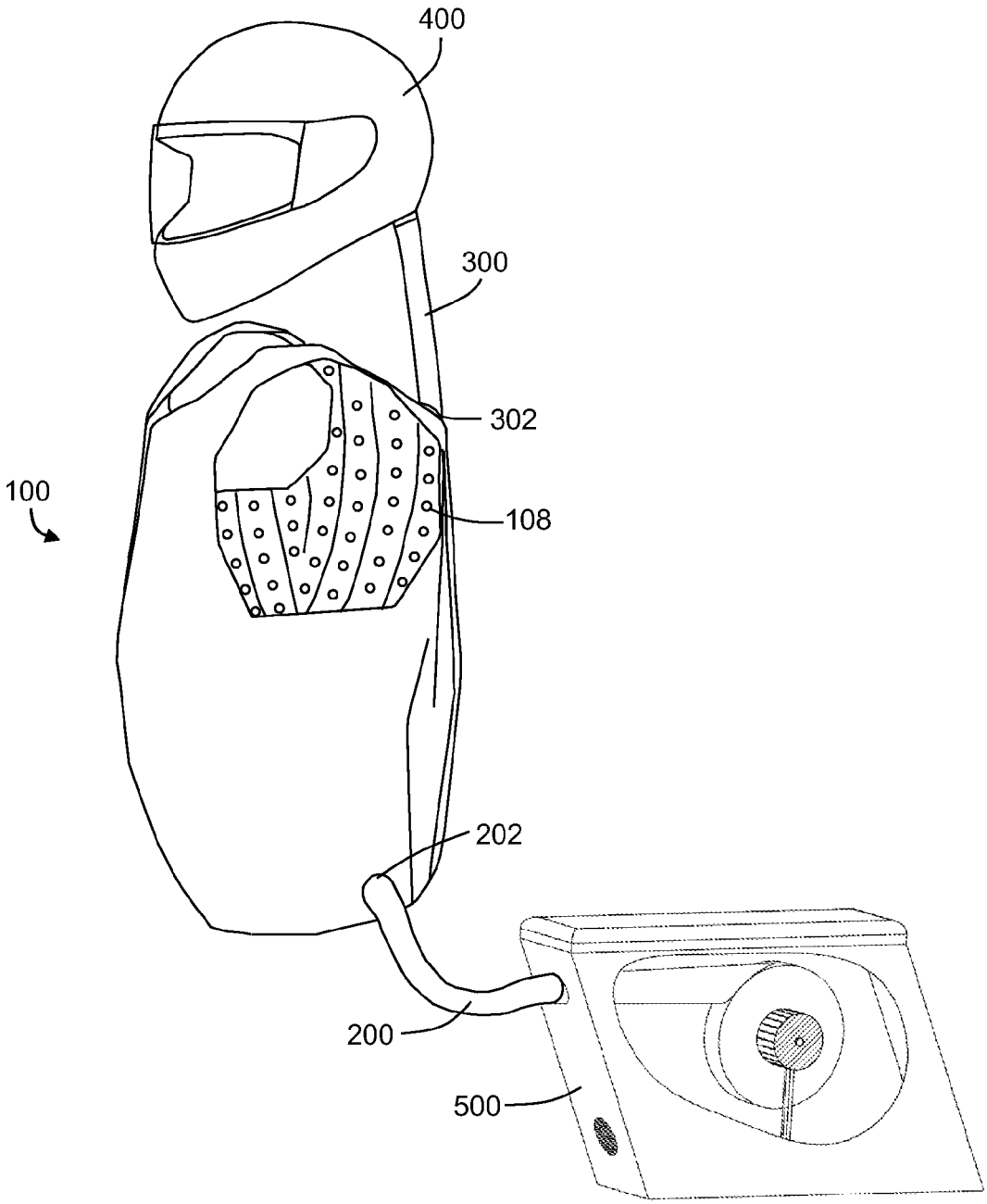
FIG. 5 is a side perspective view of FIG. 4.

FIG. 4 shows how the apparel liner 100 can be connected by an air hose 200 to an air supply 500, such as a blower. Preferably, the air supply is a blower of a centrifugal radial type with backward inclined blades, 0.5 in. blade width on a 4.0 in. disc, 12 volt DC motor, and drawing about 4 to 5 amps. At around 5000 RPM, air volume (flow) is preferably approximately 100 cubic feet per minute (CFM) and maximum static pressure is preferably 0.5 to 1.0 PSI. Preferably, heat from the jacketed motor of the blower is transferred via a heat pipe or water circulation outside of the saddlebag to limit/prevent heat from the motor being drawn into the saddlebag and subsequently into the blower inlet. Air supply hose 200 may be connected to an air blower or other air source via a break-away attachment and does not require use of a lanyard. Also shown is an upper air outlet fitting 302 that may connect to a wearer's helmet 400 and supply air flow to the helmet 400 via an outlet supply hose 300. FIG. 5 is a side perspective view of the configuration shown in FIG. 4.

In use, the liner 100 is installed within the wearer's outer apparel, often a jacket. In use, the liner 100 is attached to an air source using a flexible air supply hose 200. Air hose 200 is connected to liner 100 lower fitting 202 with a break-away attachment. Air sources may be concealed in a motorcycle saddlebag and connected with a short flexible hose 200 connecting the blower outlet to liner air inlet 202.

Figure 6:
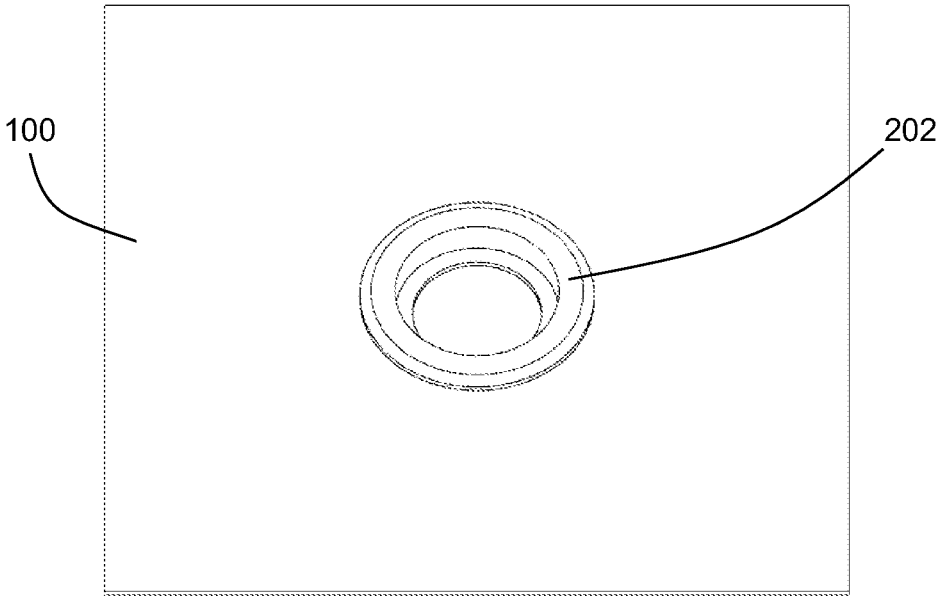
FIG. 6 is a perspective top view of a preferred embodiment of an air inlet for an apparel liner.
Figure 7A:
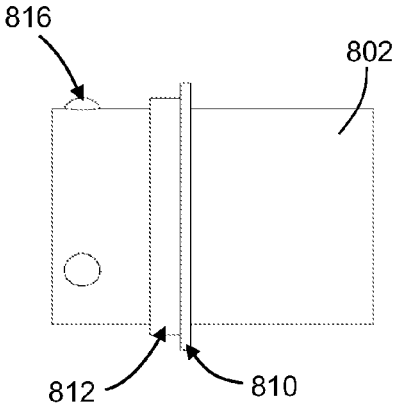
FIG. 7*a* is a side view of a preferred embodiment of a male end of an air hose for an air inlet.
Figure 7C:
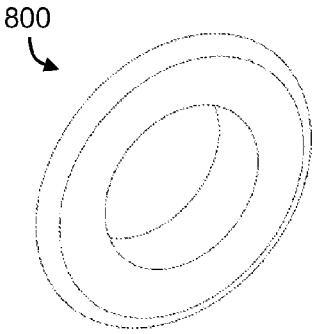
FIG. 7*c* is a perspective front view of the air inlet in FIG. 8*b;*
Figure 7B:
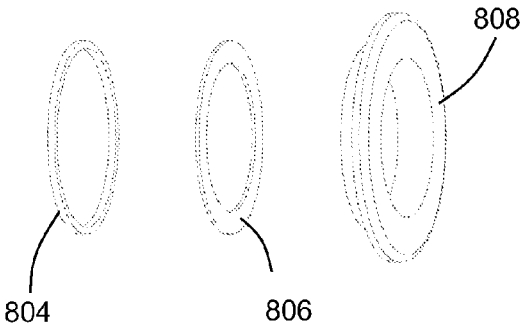
FIG. 7*b* is an exploded perspective side view of a preferred embodiment for an air inlet for an apparel liner.
Figure 7E:
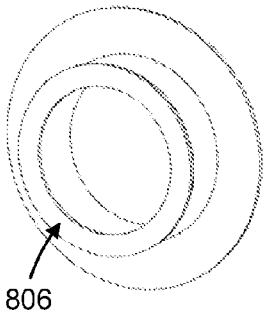
FIG. 7*e* is a perspective rear view of the air inlet in FIG. 8*b;*
Figure 7D:
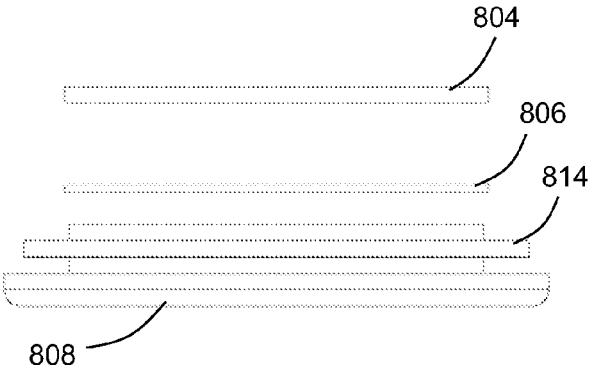
FIG. 7*d* is an exploded side view of the air inlet in FIG. 8*b;*
Figure 8A:
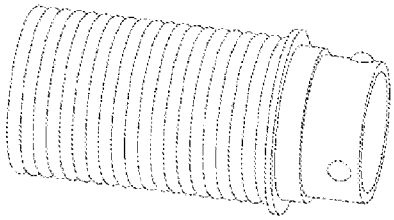
FIG. 8*a* is a perspective side view of a preferred embodiment of an air supply hose.
Figure 8B:
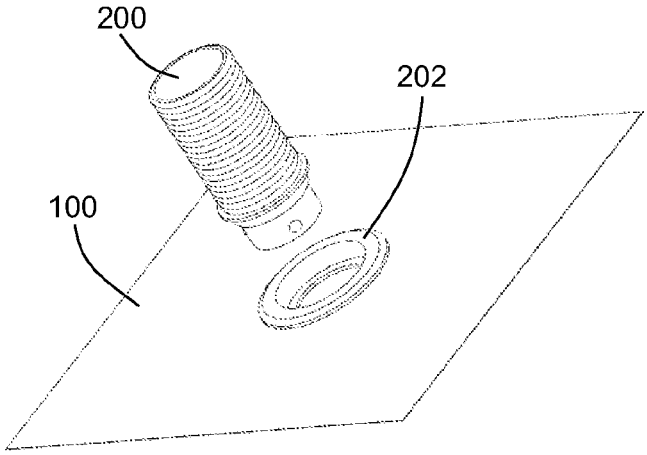
FIG. 8*b* is a perspective side view of a preferred embodiment of an air supply hose and an air inlet.
Figure 8D:
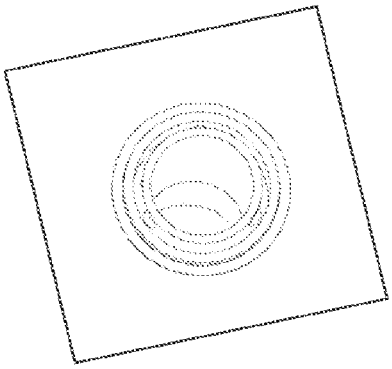
FIG. 8*d* is a perspective rear view of the air inlet in FIG. 9*b;*
Figure 8C:
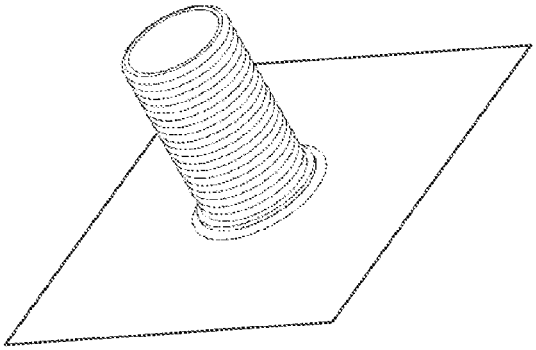
FIG. 8*c* is a perspective side view of the air supply hose and air inlet in FIG. 8*b* connected.
Figure 9:
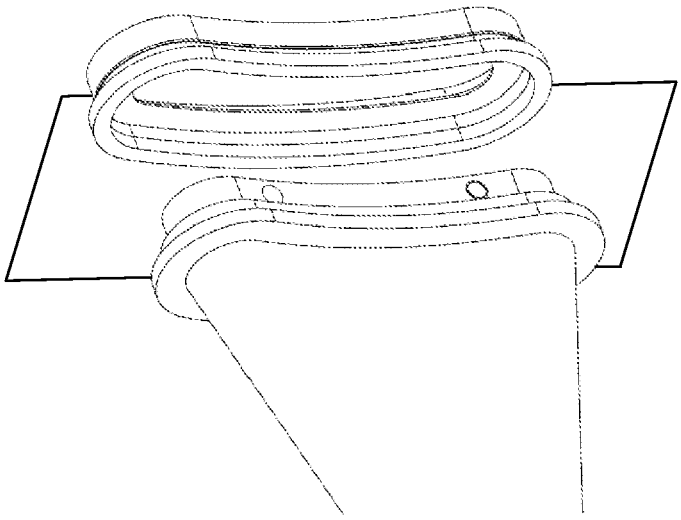
FIG. 9 is a perspective view of a bean shaped air inlet and bean shaped air supply hose.
Figure 10:
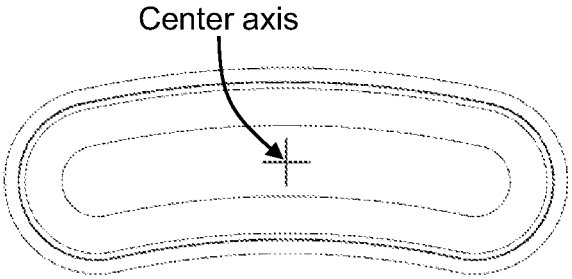
FIG. 10 is a front view of a preferred embodiment of a bean shaped air inlet; and, FIG. 11 is a perspective view of a preferred embodiment of a bean shaped air supply hose.
Figure 11:
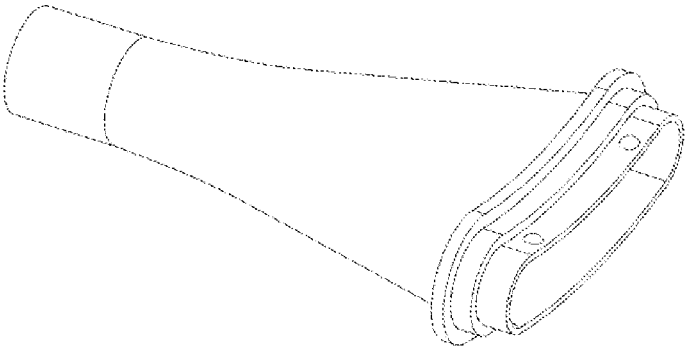

FIG. 6 shows a preferred embodiment of air inlet fitting 202 installed on an apparel liner 100. While FIG. 7 portrays a round air inlet fitting 202, an oval or bean shape may also be used as shown in FIGS. 9-11. FIGS. 7*a*-7*e* inclusive provide a detailed view of a preferred embodiment of an assembled air inlet fitting 800. Male end 802 connects the air source to air inlet fitting 202. As shown in FIG. 7*a*, inlet tube 802 has three protrusions 816 spaced equally around the tube to provide positive connection. FIG. 11 illustrates four protrusions used on the oval or bean shaped air inlet fitting. Referring back to FIGS. 7*a*-7*e*, a flange 810 and foam seal 812 provide for a secure seal and fitting. Foam seal 812 keeps inlet tube 802 centered in the inlet ring 808 and limits air escape. The seal 806 is preferably polyvinyl chloride (PVC) or a similar material bonded to the edge of inlet ring boss 808. The inner diameter of seal 806 matches the outer diameter of inlet tube 802. The seal 806 is sufficiently thick, yet wide enough to provide flexibility. This flexibility allows the protrusions on inlet tube 802 to press past the seal when light hand pressure is applied. A retainer 804 is preferably bonded over seal 806. Retainer 804 may include a skirt extending over the seal 806 and boss of inlet ring 808, which is located above a circular collar 814 (as shown in FIG. 7*d*). Seal 806 is preferably permanently bonded. The fabric of the liner 100 (not shown in FIGS. 7*a*-7*e*) is preferably cemented between inlet ring 808 and the circular collar 814.

Seal 806 is preferably permanently bonded. The fabric of the liner 100 (not shown in FIGS. 7*a*-7*e*) is cemented between inlet ring 808 and a circular collar 814. FIG. 10 illustrates the jacket liner component of an oval or bean shaped break-away air fitting.

The fitting described above has four main parts: an inlet ring 808 with a rim, a seal 806 (which may be polyvinyl chloride), a collar 814, and a retainer 804. Inlet ring 808 is sized to fit into a hole drilled or cut into a bulkhead. The bulkhead may be fabric as used in the apparel liner 100, or may be a non-flexible solid material, depending on the application. The rim of inlet ring 808 is larger than the drilled hole and prevents the inlet ring 808 from passing through the bulkhead hole. Collar 814 fits around inlet ring 808 and is glued or mechanically attached behind the rim of inlet ring 808, with the bulkhead material between the rim and collar. When attached, collar 814 secures inlet ring 808 into the hole drilled in the bulkhead material. Circular seal 806 is moderately flexible, and may be constructed of vinyl or polyvinyl chloride (PVC) or similar material, and is preferably approximately 1/16" thick. Seal 806 is glued or bonded to the air outlet side of inlet ring 808 and has a hole smaller than that of inlet ring 808. Retainer 804 is bonded to the flat surface of seal 806 away from the inlet ring 808 side of seal 806. These components may be circular, or may be oval or bean shaped, as dictated by need. When assembled, all parts preferably have a common center axis.

An air hose 200 suitable for use with the fitting described above will have a rigid or semi-rigid cuff. On the outer surface of the cuff, near the end, are preferably three round protrusions 816 (as shown in FIG. 7*a*). These protrusions are preferably half-round and are arranged around the cuff uniformly. Protrusions 816 may be cast or molded with the cuff, machined, or bonded. The cuff also preferably has a flange (for a fitting designed for a one inch internal diameter hose, the flange is about ¾ inch from the end of the cuff). If a circular fitting is designed, a circular foam seal 812 is positioned against the face of the flange. Foam seal 812 centers the cuff in the fitting, the flange butts up against the inlet ring rim, and the foam seal is pressed into the fitting by the flange when the air hose cuff is connected to the fitting.

In use, when the wearer presses the cuff end of the air hose 200 into the fitting 202, the cuff protrusions cause temporary deformation in the flexible seal 806 in the fitting 202. When the cuff is fully inserted, the seal's shape is restored in the area past the protrusions. The close fit of the seal 806 around the cuff acts to hold the cuff in place. The cuff is held in place by the following forces: the seal material creates friction between the edge of the seal and the cuff the protrusions discourage disengagement; and the outer foam seal on the cuff fits into a cavity in the inlet ring and acts to maintain friction against the cavity wall. The seal material may be selected from a range of material flexibilities, depending on the specific application and the desired amount of disconnection force. When the hose and attached cuff is pulled out, the inner seal deforms momentarily in the opposite direction allowing the protrusions to pass the seal 806, the friction of the inner and outer seals is overcome, and the cuff end breaks away from the fitting. The fitting 202 can be capped when a hose 200 is not attached.

While the description is directed toward use by motorcycle riders, the device may be used in other activities, such as other motor sports including the use of all-terrain vehicles. In addition, the device may be used in a medical setting to provide comfort cooling for patients with a variety of medical conditions. Additionally, the fittings described above may be used on a variety of applications.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary diagrams and other illustrations. As will become apparent to one of ordinary skill in the art after reading this document, the illustrated embodiments and their various alternatives may be implemented without confinement to the illustrated examples. For example, diagrams and their accompanying description should not be construed as mandating a particular architecture or configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparel liner, comprising:

an inner panel, a middle panel and an outer panel, wherein one of the inner panel and the outer panel has an air inlet configured to receive a volume of air, wherein the middle panel comprises a spacer fabric having a thickness and a cellular structure, and wherein the inner panel has a plurality of outlet holes defined therethrough;

wherein the inner, middle and outer panels are layered and attached fixedly together, wherein the middle panel spaces the inner panel from the outer panel such that a liner interior is defined between an inner surface of the inner panel and an inner surface of the outer panel, and wherein an airflow path is defined between the air inlet, the liner interior and the plurality of outlet holes in the inner panel, whereby the volume of air can flow in through the air inlet, through the liner interior, and out through any one of the plurality of outlet holes.

2. The apparel liner of claim 1, wherein the inner panel includes resistive heating elements.

3. The apparel liner of claim 1, where the liner further comprises a collar, wherein a portion of the liner interior is defined in the collar, wherein an air outlet is defined in the outer layer in the collar, and wherein the air outlet is part of the airflow path.

4. The apparel liner of claim 1, where the air inlet includes a fitting that is a break-away fitting.

5. The apparel liner of claim 1, wherein the inner layer comprises a fabric that includes a plurality of interstices each having an area dimension, wherein the outlet holes each have an area dimension that is larger than the area dimension of any of the interstices.

6. The apparel liner of claim 1 where the cellular structure of the middle panel is a honeycomb shape.

7. The apparel liner of claim 1 where the layers are connected by a plurality of loop stitches.

8. An apparel liner cooling system comprising:

an apparel liner with a first layer having an air inlet, a second middle layer having a spacer with a thickness, and a third layer that has a plurality of outlet holes defined therethrough; where the three layered panels are attached fixedly together and are configured to be spaced apart from a user;

an air supply hose attached to the air inlet on the apparel liner; and, an air source;

wherein the second layer spaces the first layer from the third layer such that a liner interior is defined between an inner surface of the first layer and an inner surface of the third layer, and wherein the outlet holes in the third layer are in airflow communication with the air inlet in the first layer.

9. The apparel liner cooling system of claim 8 where the air supply hose has an end with a plurality of protrusions that connects to a fitting associated with the air inlet by placing the plurality of protrusions behind a seal on the air inlet fitting.

10. The apparel liner cooling system of claim 8 where the apparel liner further comprises a resistive heating element.

11. The apparel liner cooling system of claim 8 where the apparel liner further comprises a collar, wherein a portion of the liner interior is defined in the collar, and wherein an air outlet is defined in the outer layer in the collar, and wherein the system further comprises an outlet hose connected to a fitting associate with the air outlet and that is adapted to be connected to a helmet.

12. The apparel liner cooling system of claim 8 where the cellular structure of the middle panel is a honeycomb shape.

13. The apparel liner cooling system of claim 8 where the layers are connected by a plurality of loop stitches.

14. The apparel liner of claim 1, wherein the inner layer includes a coating thereon that prevents air from flowing through the inner layer at any location other than the outlet holes.

15. The apparel liner of claim 1, wherein the volume of air exceeds 100 cubic feet per minute.

16. The apparel liner of claim 1, wherein the air inlet is defined in the outer panel.

17. The apparel liner of claim 1, wherein the cellular structure of the middle panel comprises a plurality of cells that are configured to allow air to flow therethrough, whereby the plurality of cells are a part of the airflow path.

18. The apparel liner cooling system of claim 8 wherein an airflow path is defined such that air moves from the air source, through the air supply hose, through the air inlet, through the liner interior and out of any one of the plurality of outlet holes.

* * * * *